US006702126B2

(12) United States Patent
Park

(10) Patent No.: US 6,702,126 B2
(45) Date of Patent: Mar. 9, 2004

(54) DISPLAY RACK STAND FOR HAIRBRUSH

(76) Inventor: Ran-kiu Park, 5-103, Hyochang-dong, Yongsang-gu, Seoul (KR)

( * ) Notice: Subject to any disclaimer, the term of this patent is extended or adjusted under 35 U.S.C. 154(b) by 0 days.

(21) Appl. No.: 10/061,370

(22) Filed: Feb. 1, 2002

(65) Prior Publication Data

US 2003/0111433 A1 Jun. 19, 2003

(30) Foreign Application Priority Data

Dec. 10, 2001 (KR) ..... 2001-38010 U

(51) Int. Cl.[7] ..... A47F 7/00

(52) U.S. Cl. ..... 211/59.1; 211/66; 211/193; 211/194

(58) Field of Search ..... 211/59.1, 57.1, 211/193, 66, 189, 194; D6/462, 463, 465

(56) References Cited

U.S. PATENT DOCUMENTS 810,829 A * 1/1906 Ward
D106,230 S * 9/1937 Fawcett
2,246,692 A * 6/1941 Ohme ..... 211/59.1
2,626,061 A * 1/1953 Girouard ..... 211/59.1
3,139,985 A * 7/1964 Sinclair ..... 211/59.1
3,567,036 A * 3/1971 Tonjum et al. ..... 211/57.1
4,007,841 A * 2/1977 Seipel ..... 211/59.1
D325,136 S * 4/1992 Lucht ..... D6/465
5,303,830 A * 4/1994 Metcalf ..... 211/57.1
5,526,941 A * 6/1996 Ford ..... 211/59.1
D400,728 S * 11/1998 Tate ..... D6/462 X

* cited by examiner

*Primary Examiner*—Robert W. Gibson
(74) *Attorney, Agent, or Firm*—Westman, Champlin & Kelly, P.A.

(57) ABSTRACT

A display rack stand for a hairbrush has a base plate and support bars standing upright from opposing ends of the base plate in a manner of being removably connected to the opposing ends of the base plate, a support panel of a bridge shape which is positioned between the support bars and connecting and supporting opposing upper ends of the support bars, and hangers removably connected to holding grooves of the support panel to hold certain items like a hairbrush thereon in an arranged manner. The display rack stand is easy to assemble and disassemble, and therefore, it is capable of not only increasing packing and transportation efficiency, but also increasing display effectiveness and space utilization greatly.

6 Claims, 8 Drawing Sheets

DISPLAY RACK STAND FOR HAIRBRUSH

The present application claims priority of Korean patent application Ser. No. 2001-38010, filed Dec. 10, 2001.

BACKGROUND OF THE INVENTION

1. Field of the Invention

The present invention relates to a display rack stand for displaying small things hanging thereon, and more particularly, to a display rack stand for a hairbrush capable of improving the packing and transportation efficiency as the display rack stand is easily assembled and disassembled.

2. Description of the Related Art

Generally, small things such as a hairbrush are sold being displayed in a predetermined pattern. The hairbrush is displayed being hung on a rack stand.

For example, as shown in FIG. 1, most display rack stands for the hairbrush are three-dimensional frame rack having a various shape and structure by forming-processing a wire 11 such as bending, cutting, and welding.

Therefore, as the conventional display rack stand 10 for hairbrush is bulk and also assembling and disassembling is hard, the amount of the products for packing and transporting is limited, and the manufacturing cost is increased. Moreover, the conventional display rack stand 10 is easily deformed or broken by external shock during the transportation.

SUMMARY OF THE INVENTION

The present invention has been made to overcome the above-mentioned problems of the conventional display rack stand for hairbrush, and accordingly, it is an object of the present invention to provide a display rack stand for a hairbrush which is easy to assemble and disassemble, thereby being capable of increasing the packing and transporting efficiency and thus reducing manufacturing cost, and also increasing the display effect.

Another object of the present invention is to provide a display rack stand for a hairbrush capable of maximizing space utilization as well as display effect by employing a multi-layered structure.

The above objects are accomplished by a display rack stand for a hairbrush according to the present invention, including a base plate; a support frame standing upright on the base plate in a manner of being removably connected to the base plate; and a hanger removably connected to the support frame, protruding forward to be placed over the base plate.

The support frame includes at least two support bars standing upright on opposing ends of the base plate, in a manner of being removably connected to the opposing ends of the base plate, and a support panel of a bridge shape which is positioned between the support bars, connecting and supporting upper ends of the support bars. The support panel has a plurality of holding grooves formed therein.

The support bars are connected with at least two another support bars that are successively stacked on the support bars in a sequential manner, building up plural layers. There is a support panel having a hanger connected thereto, which is disposed between the support bars and between another support bars.

Disposed on the upper end of the support panel is a display panel. The display panel is removably connected to a guide rail groove formed in the upper end of the support panel, as the display panel is slid along the guide rail groove.

The hanger has a rear connection portion connected to the holding groove; a body portion protruding forward from the support panel in a perpendicular relation to the rear connection portion; and a front protruding portion upwardly bent from the body portion, such that the rear connection portion, the body portion and the front protruding portion constitute a shape substantially of alphabet letter 'L'.

Protruding downward from a lower surface of each support bar is a connection protrusion, which is removably connected to a connection groove formed in the base plate.

The above object is also accomplished by a display rack stand for a hairbrush according to the present invention, including: a base plate; at least two support bars standing upright on opposing ends of the base plate, in a manner of being removably connected to the opposing ends of the base plate; a support panel of a bridge shape which is positioned between the support bars, connecting and supporting upper ends of the support bars, the support panel having a plurality of holding grooves formed therein; a plurality of hangers removably connected to the holding grooves of the support panel, and protruding frontward to be placed over an upper portion of the base plate; and a display panel disposed on an upper end of the support panel.

BRIEF DESCRIPTION OF THE DRAWINGS

The object and the feature of the present invention will be more apparent by describing the preferred embodiments of the present invention by referring to the appended drawings, in which.

DETAILED DESCRIPTION OF THE PREFERRED EMBODIMENTS

Hereinbelow, the preferred embodiments of the present invention will be described in greater detail by referring to the appended drawings.

Figure 1:
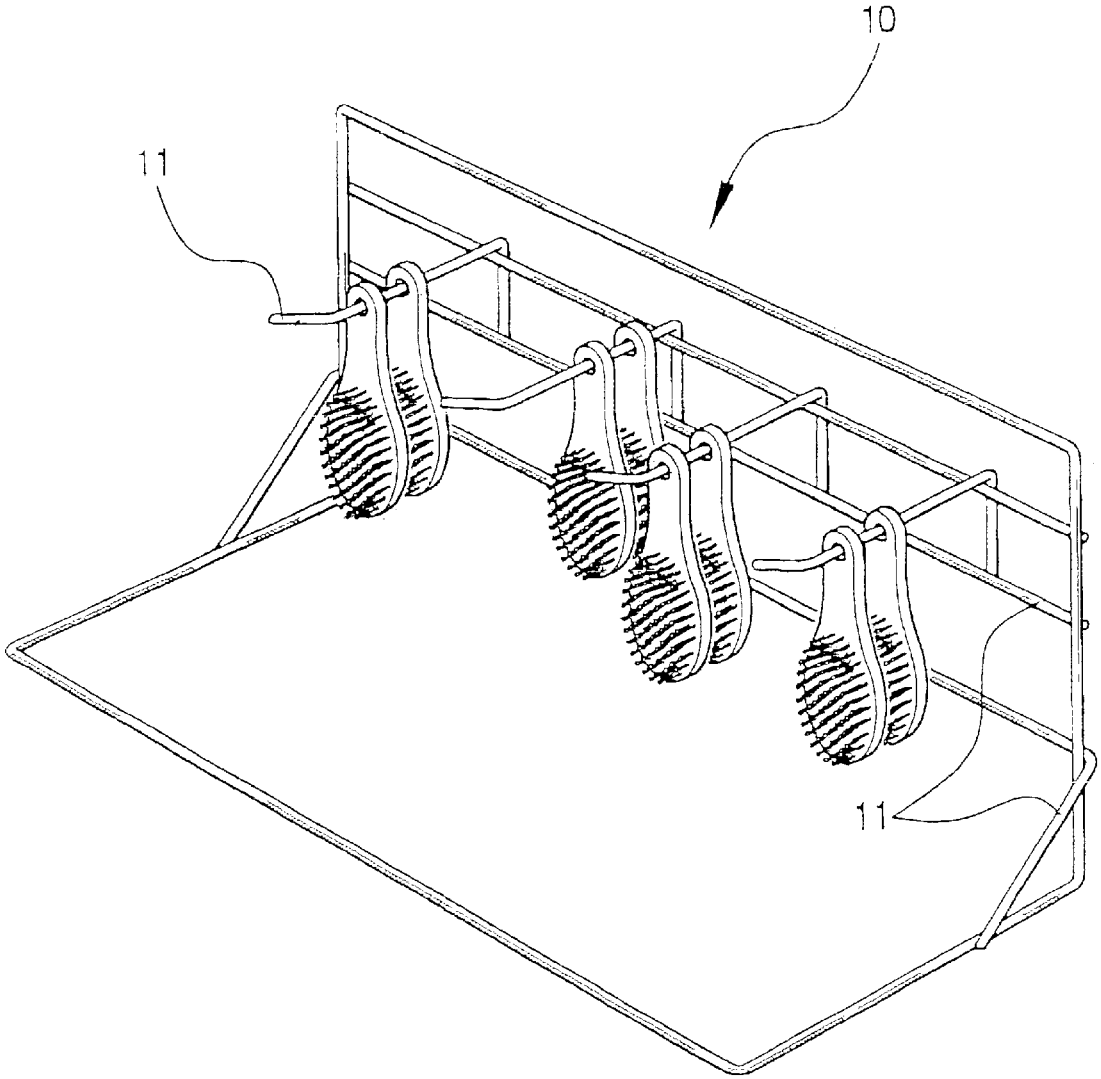
FIG. 1 PRIOR ART
FIG. 1 is a perspective view schematically showing a conventional display rack stand for a hairbrush.
Figure 2A:
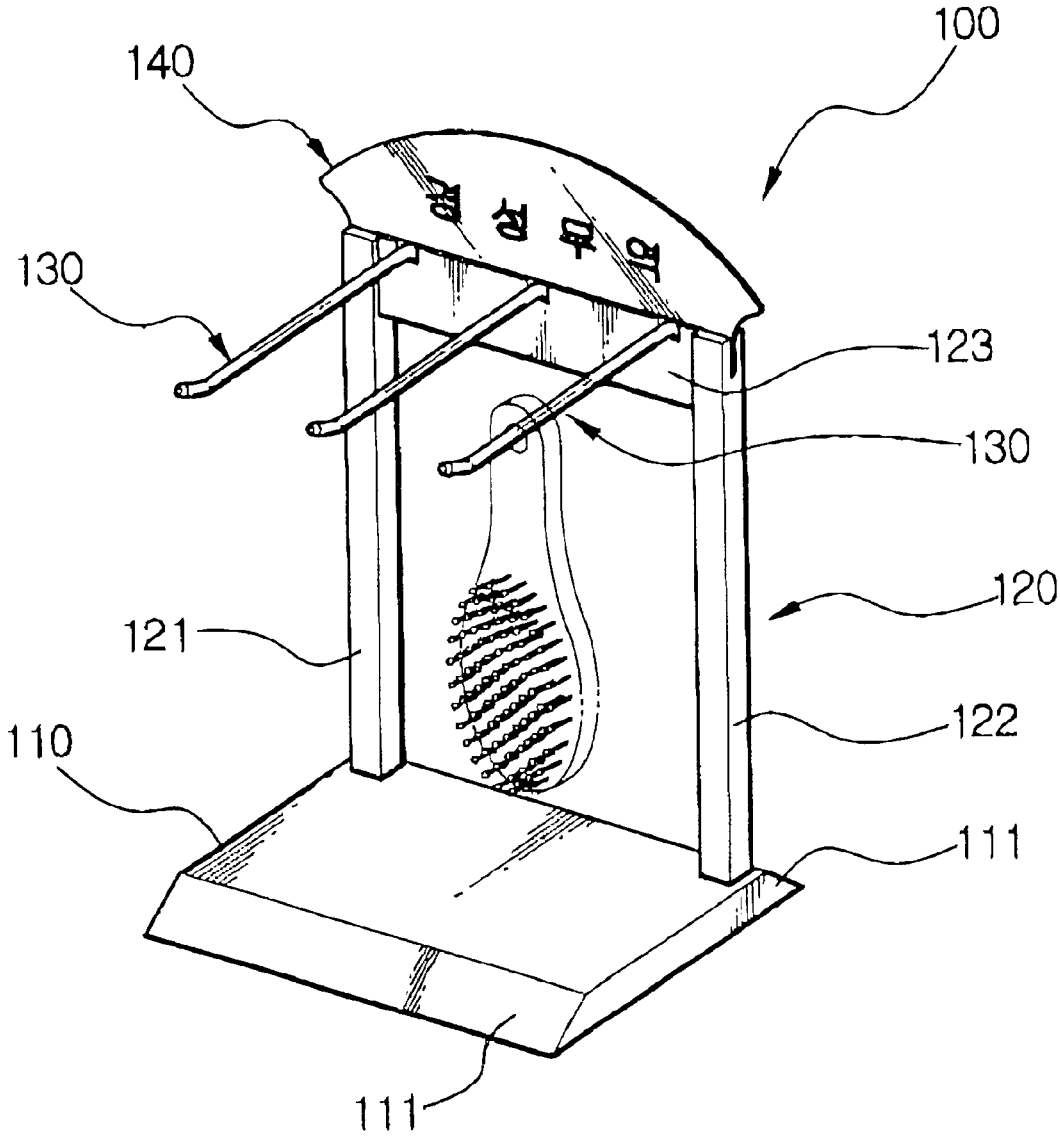
FIG. 2A is a perspective view schematically showing a display rack stand for a hairbrush according to the present invention.
Figure 2B:
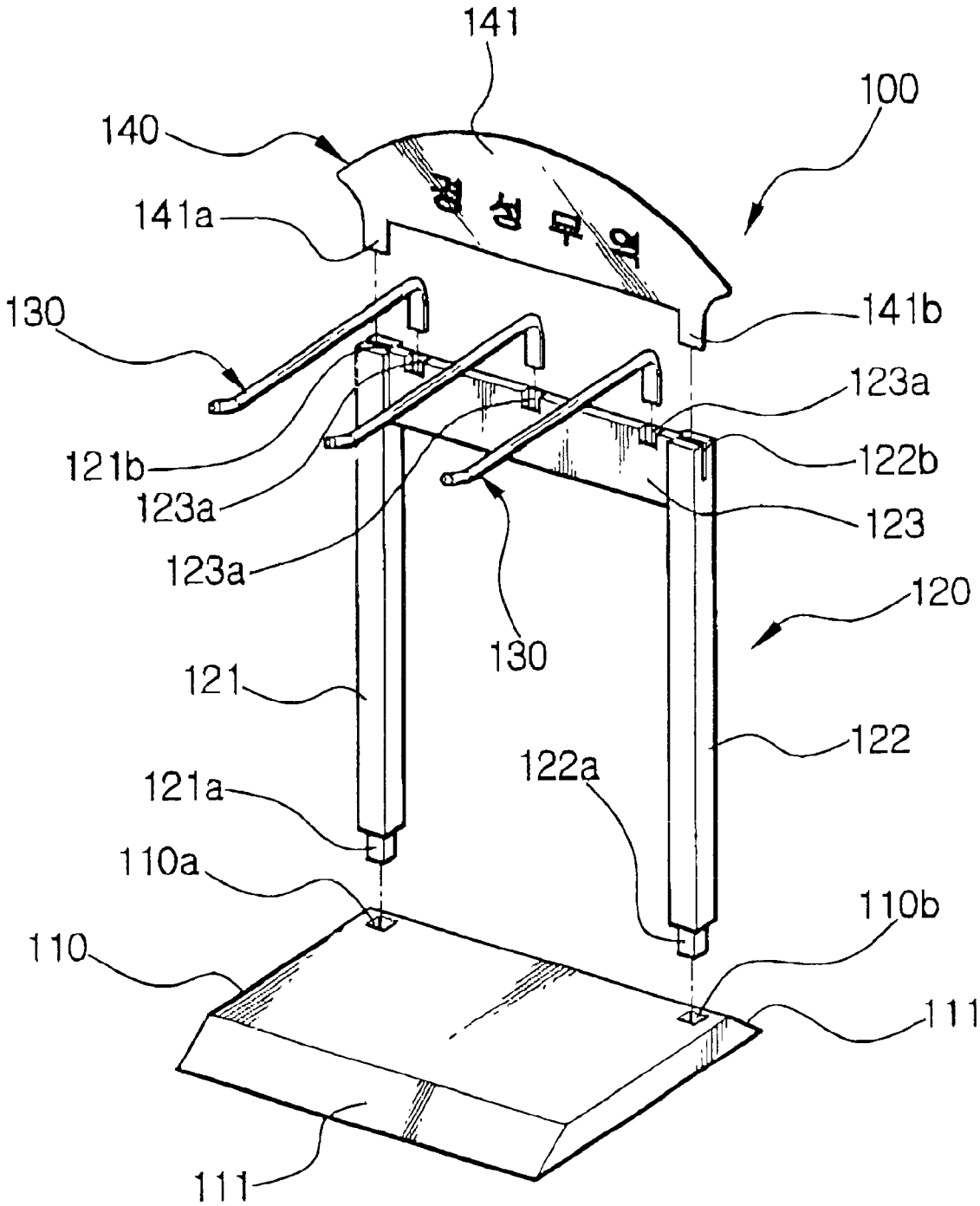
FIG. 2B is an exploded perspective view schematically showing a display rack stand for a hairbrush according to the present invention.
Figure 2C:
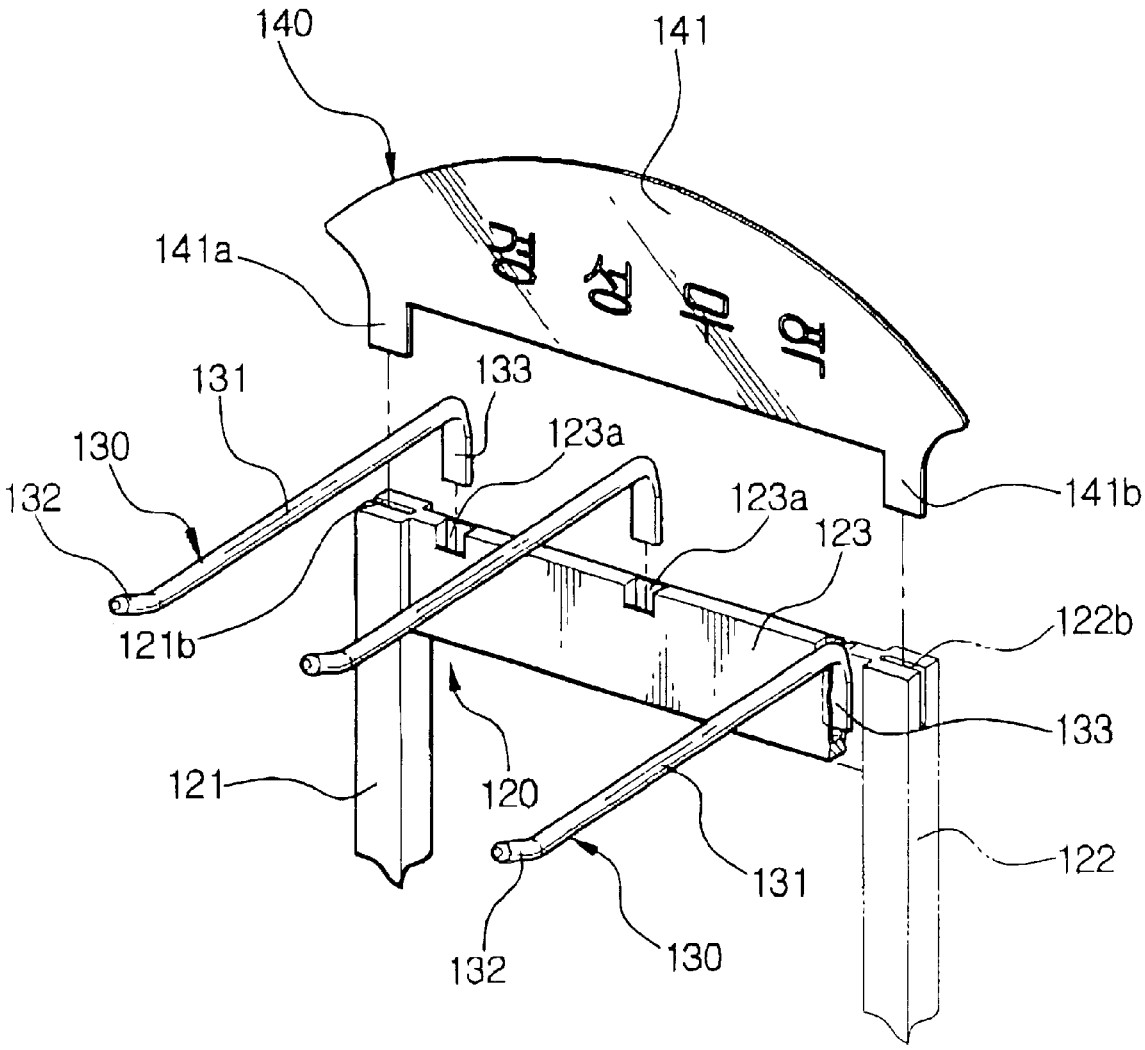
FIG. 2C is an exploded perspective view schematically showing an important part of a display rack stand for a hairbrush according to the present invention.

Referring to FIGS. 2A through 2C, a display rack stand for a hairbrush 100 has a support frame 120 removably connected to a base plate 110 while standing upright on the base plate 110, and hangers 130 protruding forward to be placed over the base plate 110. The hangers 130 are removably connected with the support frame 120.

According to the present inventions the base plate 110 has predetermined sloping sides 111 at a front end and a back end. Thus, the base plate 110 is a plate stand base shaped substantially of a roof.

The supporting frame 120 includes standing support bars 121 and 122 removably connected with both ends at backside of the base plate 110, and a support panel 123 placed at an upper part between the support bars 121 and 122. The support panel 123 is shaped like a bridge connecting the support bars 121 and 122, and has a plurality of holding grooves 123*a* formed therein.

Connection protrusions 121*a* and 122*a* are protruded downward from a lower side of the support bars 121 and 122. The connection protrusions 121*a* and 122*a* stand upright and are removably connected with connection holes 110*a* and 110*b* formed in both ends at the backside of the base plate 100.

The support panel 123 is in the shape of a bridge placed between the support bars 121 and 122 in order to connect and support the upper parts of the support bars 121 and 122.

The plurality of holding grooves 123*a* is disposed at the upper part of the support panel 123. The hangers 130 are removably connected with the holding grooves 123*a*.

As shown in FIG. 2C, the hangers 130 has a shape of alphabet letter 'L', as a front and 132 and a back end 133 of a body 131 of the hanger 130 are bent for a predetermined degree in a corresponding direction.

The back end 133 of the hanger 130 is bent to be orthogonal in relative to the body 131, and has a compressed plate shape like a front end of a chisel. The back end 133 of the hanger 130 is removably connected with the holding grooves 123*a* of the support panel 123. Moreover, the front end 132 of the hangers 130 are bent upwardly for a predetermined angle with respect to the body 131 and protruded towards the front of the support panel 123. According to the above structure, when small things such as the hairbrush 1 are hung on the body 131 in a certain arrangement, the hairbrush 1 can be prevented from being separated as the front end 123 is bent.

In the meantime, in the present invention, it is preferable that the base plate 110, the support bars 121 and 122, and the support panel 123 are made from injection-molding synthetic resins. Moreover, it is advisable that the hangers 130 are made by bending a wire having a predetermined thickness.

According to one aspect of the present invention, the support bars 121 and 122 and the support panel 123 of the support frame 120 can be integrally formed with each other. On the other hand, the support bars 121 and 122 and the support panel 123 can be separately made and connected with each other.

Albeit not shown, when the support bars 121 and 122 and the support panel 123 are made separately, slits (not shown) can be formed inside of the support bars 121 and 122. Thus, the support bars 121 and 122 can be removably connected to the support panel 123 by sliding both ends of the support panel 123 into the slits of the support bars 121 and 122.

The reference numeral 140 is a display panel for a commercial object such as an effect of advertisement about the product being displayed and the maker. The display panel 140 is a plate panel and can take various shape such as an arch as shown, or a square shape.

The display panel 140 has a plate body 141, and connection protrusions 141*a* and 141*b* formed at both lower parts of the body 141. As the connection protrusions 141*a* and 141*b* are connected with grooves 121*b* and 122*b* formed at upper ends of the support bars 121 and 122, the display panel 140 is removably connected with the upper end of the support bars 121 and 122 and the support panel 123.

Figure 3A:
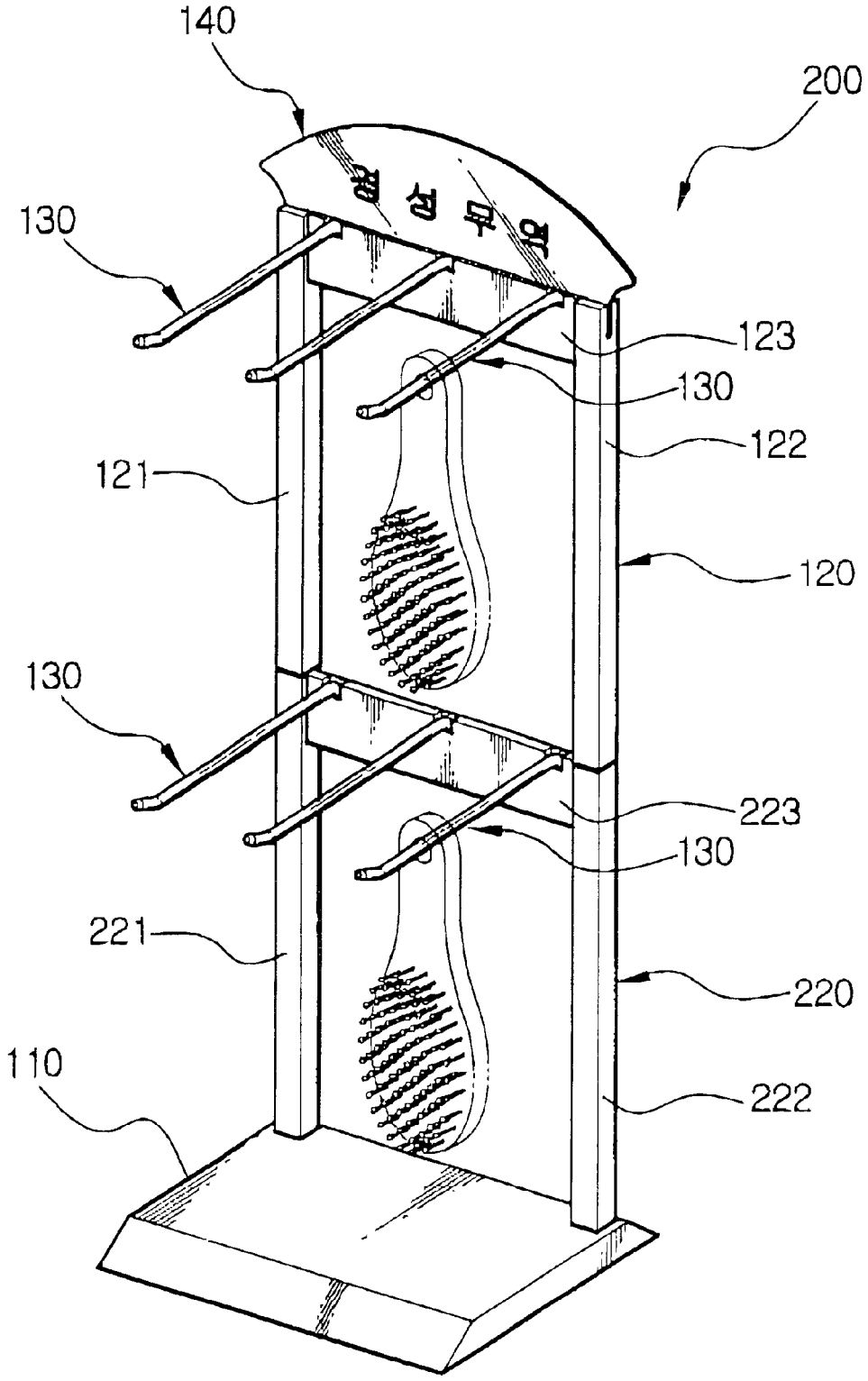
FIGS. 3A and 3B are a combined perspective view and an exploded perspective view, respectively, schematically showing another preferred embodiment of the present invention.
Figure 3B:
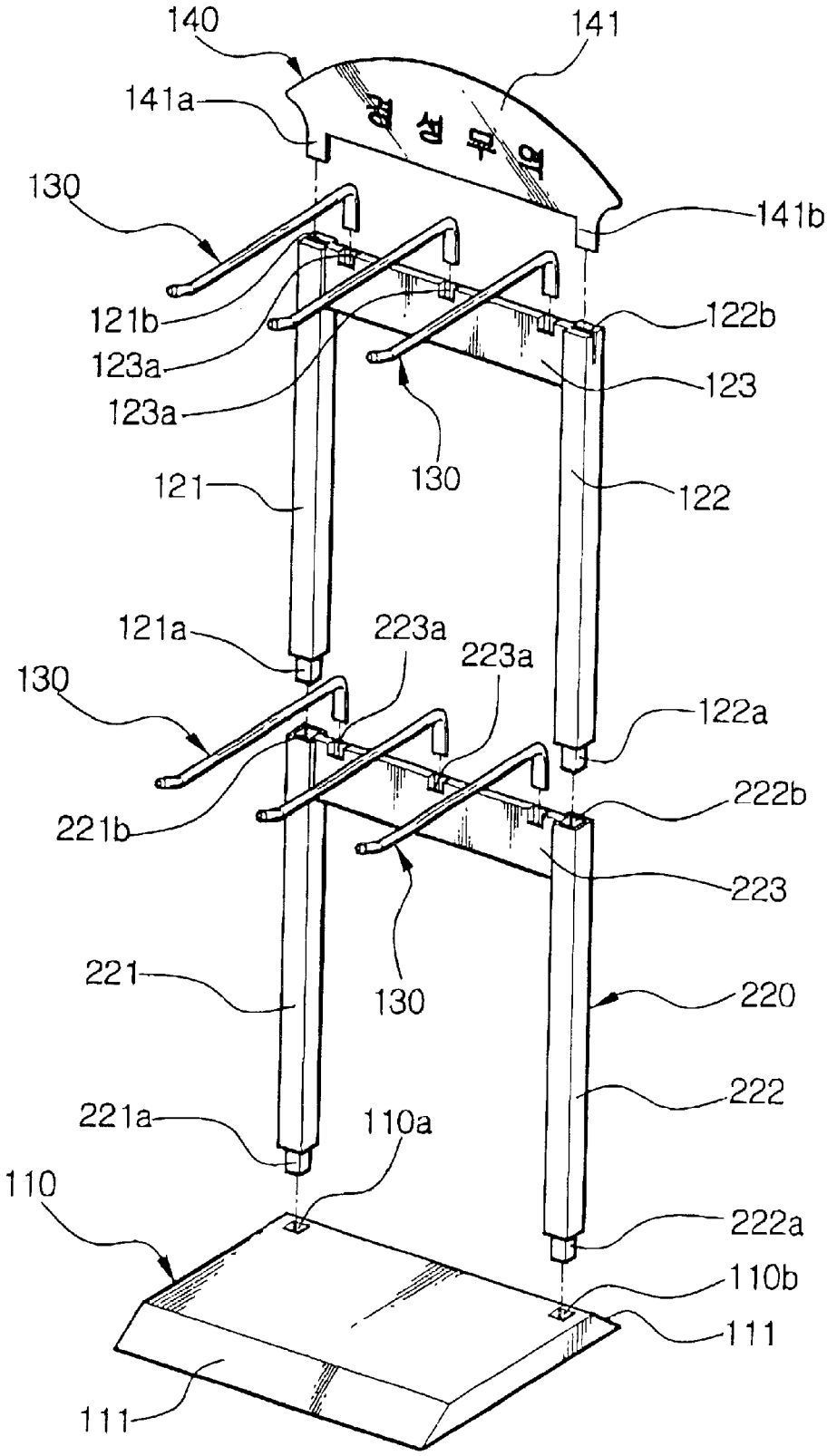
Figure 3C:
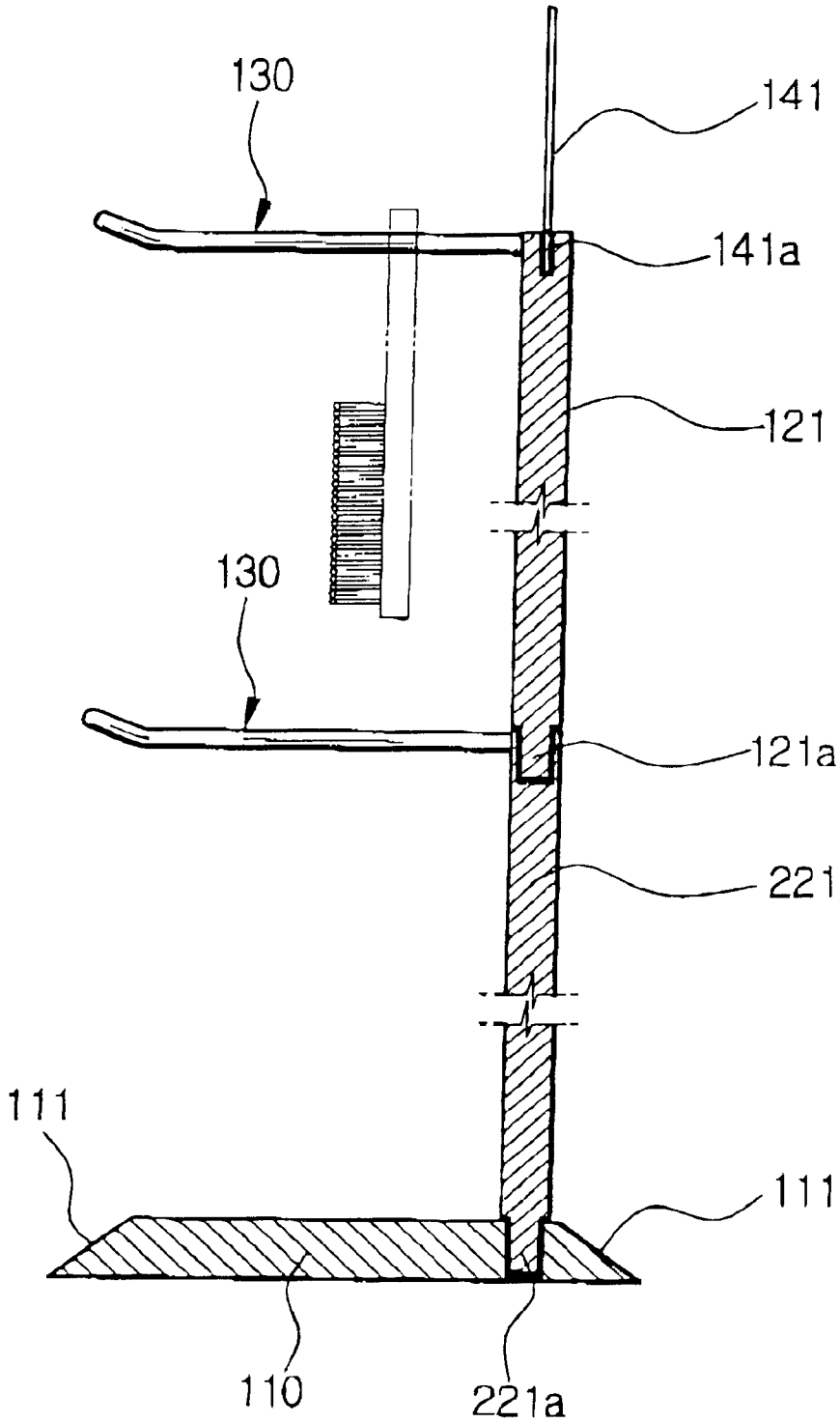
FIG. 3C is a schematic sectional view taken on line III—III of FIG. 3A.

As another preferred embodiment of the present invention, the display rack stand 100 for a hairbrush can be manufactured having two layers as shown in FIGS. 3A through 3C.

Referring to FIGS. 3A through 3C, the display rack stand 200 for a hairbrush according to another preferred embodiment of the present invention is formed to have two layers as a second support plate 220 is disposed between the base plate 110 and the support frame 120.

The second support frame 220 has the same structure as the above-described support frame 120. The second support frame 220 has standing support bars 221 and 222 removably connected with both ends at backside of the base plate 110, and a support panel 223 placed at an upper part between the support bars 221 and 222. The support panel 223 has a bridge shape to connect the support bars 221 and 222, and has a plurality of holding grooves 223*a*.

Connection protrusions 221*a* and 222*a* protrude downward from a lower side of the support bars 221 and 222. The connection protrusions 221*a* and 222*a* are removably connected to connection holes 110*a* and 110*b* formed at both ends at the backside of the base plate 110 while standing upright.

Moreover, connection holes 221*b* and 222*b* connected with connection protrusions 121*a* and 122*a* formed at bottoms of support bars 121 and 122 of the support frame 120 are formed at upper part of the support bars 221 and 222.

Therefore, as the support frame 120 is placed on the support bars 221 and 222 of the second support frame 220, and the connection protrusions 121*a* and 122*a* of the support bars 121 and 122 are connected with the connection holes 221*b* and 222*b* of the support bars 221 and 222, the overall structure of the stand becomes two layers.

Hangers 130 are removably connected with the support panel 223 according to the same structure as the one layered rack stand.

According to the structural characteristic described so far, the display rack stand for hairbrush can have multi-layered structure although it was not exemplified here.

Figure 4:
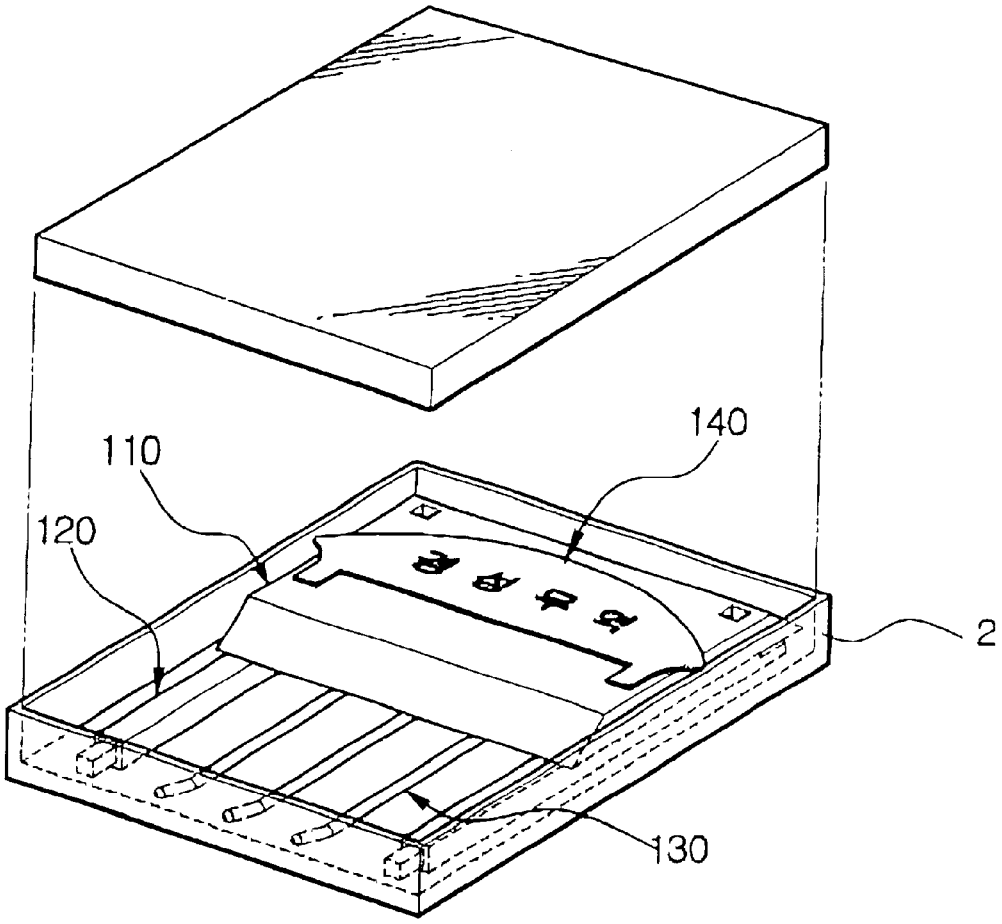
FIG. 4 is a perspective view schematically showing a display rack stand for a hairbrush according to the present invention being disassembled and packed.

On the other hand, as shown in FIG. 4, the display rack stand for a hairbrush according to the present invention can be easily carried or transported since the base plate 110, the support frames 120 and 220, the hangers 130, and the display panel 140 are disassembled and put into a packing material 2 such as a box or a plastic bag.

According to the display rack stand for a hairbrush having the above structure of the present invention, several effects can be expected.

Firstly, logistics expenses are reduced due to easy disassembling and assembling and high storage and transportation efficiency.

Secondly, since the rack stand is structured as multi-layered, display effect and space efficiency can be optimized.

So far, the preferred embodiments of the present invention have been illustrated and described. However, the present invention is not limited to the preferred embodiments described here, and someone skilled in the art can modify the present invention without distorting the point of the present invention claimed in the claim part.

What is claimed is:

1. A display rack stand for a hairbrush, comprising:

a base plate;

a support frame standing upright on the base plate in a manner of being removably connected to the base plate;

a hanger removably connected to the support frame, protruding forward to be placed over the base plate;

wherein the support frame comprises:

at least two support bars standing upright on opposing ends of the base plate, in a manner of being removably connected to the opposing ends of the base plate; and a support panel of a bridge shape which is positioned between the support bars, connecting and supporting upper ends of the support bars, the support panel having a plurality of holding grooves formed therein;

wherein the support bars are connected with at least two other support bars that are successively stacked on the support bars in a sequential manner, building up plural layers, the support bars and the other support bars being provided with support panel of a bridge shape which has a hanger connected thereto and is disposed between the support bars and between the other support bars, respectively;

wherein, disposed on the upper end of the support panel is a display panel.

2. The display rack stand of claim 1, wherein, protruding downward from opposing lower ends of the display panel is a connection protrusion, which is removably connected to a groove formed in the upper end of each support bar.

3. The display rack stand of claim 1, wherein the hanger comprises: a rear connection portion connected to the holding groove; a body portion protruding forward from the support panel in a perpendicular relation to the rear connection portion; and a front protruding portion upwardly bent from the body portion, the rear connection portion, the body portion and the front protruding portion constituting a shape substantially of alphabet letter 'L'.

4. The display rack stand of claim 1, wherein, protruding downward from a lower surface of each of the support bars is a connection protrusion, which is removably connected to a connection groove formed in the base plate.

5. The display rack stand of claim 1, wherein each of the support bars has a groove formed in the upper end to receive the connection protrusion downwardly protruding from the lower surface of each of the other support bars.

6. A display rack stand for a hairbrush, comprising:

a base plate;

at least two support bars standing upright on opposing ends of the base plate, in a manner of being removably connected to the opposing ends of the base plate;

a support panel of a bridge shape which is positioned between the support bars, connecting and supporting upper ends of the support bars, the support panel having a plurality of holding grooves formed therein;

a plurality of hangers removably connected to the holding grooves of the support panel, and protruding frontward to be placed over an upper portion of the base plate; and a display panel disposed on an upper end of the support panel.

* * * * *